US008369723B2

(12) United States Patent
Hosoda

(10) Patent No.: US 8,369,723 B2
(45) Date of Patent: Feb. 5, 2013

(54) PRINTING APPARATUS AND CONTROL METHOD THEREOF

(75) Inventor: Osamu Hosoda, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 461 days.

(21) Appl. No.: 12/648,493

(22) Filed: Dec. 29, 2009

(65) Prior Publication Data

US 2010/0189450 A1 Jul. 29, 2010

(30) Foreign Application Priority Data

Jan. 23, 2009 (JP) ..... 2009-013396

(51) Int. Cl.
*G03G 15/00* (2006.01)
*G03G 15/20* (2006.01)

(52) U.S. Cl. ..... 399/45; 399/69

(58) Field of Classification Search ..... 399/45, 399/67, 69

See application file for complete search history.

(56) References Cited

U.S. PATENT DOCUMENTS 4,008,957 A * 2/1977 Summers ..... 399/23
2008/0267644 A1* 10/2008 Murakami ..... 399/45

FOREIGN PATENT DOCUMENTS

CN 101295150 A 10/2008
JP 7-72678 3/1995

OTHER PUBLICATIONS

Chinese Office Action (w/translation), dated Aug. 31, 2012, issued in counterpart Chinese Patent Application No. 201010001286.7.

* cited by examiner

*Primary Examiner* — David Gray
*Assistant Examiner* — Andrew Do
(74) *Attorney, Agent, or Firm* — Fitzpatrick, Cella, Harper & Scinto

(57) ABSTRACT

This invention provides an image forming apparatus which performs fixing control complying with sheet characteristics in consideration of the productivity of a printing process and the precision of fixing control, and a control method thereof. To accomplish this, upon receiving a print job, the image forming apparatus extracts a sheet type used in the print job, and determines whether one set value in fixing control can be used for the extracted sheet type. If one set value can be used for the extracted sheet type, the image forming apparatus decides a common set value. If one set value cannot be used for the extracted sheet type, the image forming apparatus decides a set value for each type. In accordance with the decided set value, the image forming apparatus executes a printing process.

18 Claims, 16 Drawing Sheets

FIG. 4

FIXING TEMPERATURE AT START OF PRINTING [ ℃]

| LOWER LIMIT VALUE OF GRAMMAGE \ UPPER LIMIT VALUE OF GRAMMAGE | 80 | 106 | 129 | 151 | 181 | 210 | 257 | 300 |
|---|---|---|---|---|---|---|---|---|
| 64 | 200 | 200 | 208 | 208 | 212 | 215 | 215 | 218 |
| 80 | 200 | 200 | 210 | 210 | 212 | 215 | 215 | 218 |
| 106 | – | 200 | 210 | 210 | 215 | 215 | 215 | 218 |
| 129 | – | – | 210 | 210 | 215 | 218 | 218 | 220 |
| 151 | – | – | – | 210 | 215 | 218 | 218 | 220 |
| 181 | – | – | – | – | 215 | 218 | 218 | 220 |
| 210 | – | – | – | – | – | 218 | 218 | 220 |
| 257 | – | – | – | – | – | – | 218 | 220 |

401

403

402

FIG. 5

| SHAPE / MATERIAL \ SURFACE PROPERTY | NORMAL | ONE-SIDE COATED | TWO-SIDE COATED | EMBOSSED | ROUGH | VELLUM |
|---|---|---|---|---|---|---|
| NORMAL | ○ | ○ | × | × | × | × |
| TAB | ○ | ○ | × | × | × | × |
| PREPRINTED | ○ | × | × | × | × | × |
| OHP | × | × | × | × | × | × |
| RECYCLED PAPER | ○ | × | × | × | × | × |

501

503

502

FIG. 6

| 601 | 602 | 603 |
|---|---|---|
| PRINTING MEDIUM TYPE | GRAMMAGE RANGE | FIXING TEMPERATURE |
| THIN PAPER | 64~79 | 200℃ |
| PLAIN PAPER | 80~105 | 200℃ |
| THICK PAPER 1 | 106~128 | 210℃ |
| THICK PAPER 2 | 129~150 | 210℃ |
| THICK PAPER 3 | 151~180 | 215℃ |
| THICK PAPER 4 | 181~219 | 218℃ |
| THICK PAPER 5 | 220~256 | 218℃ |
| THICK PAPER 6 | 257~300 | 220℃ |

FIG. 16

| | | |
|---|---|---|
| [DECK1]<br>A4 PLAIN PAPER<br>SWITCHING=ON | [DECK4]<br>A4 THICK PAPER FOR COVER<br>SWITCHING=OFF | [DECK7]<br>A4 THICK PAPER 1<br>SWITCHING=OFF |
| [DECK2]<br>A3 THICK PAPER 2<br>SWITCHING=ON | [DECK5]<br>A3 THICK PAPER 3<br>SWITCHING=OFF | [DECK8]<br>A3 THICK PAPER 5<br>SWITCHING=OFF |
| [DECK3]<br>A3 THICK PAPER 3<br>SWITCHING=ON | [DECK6]<br>A3 PLAIN PAPER<br>SWITCHING=ON | [DECK9]<br>A3 PLAIN PAPER<br>SWITCHING=ON |

PRINTING APPARATUS AND CONTROL METHOD THEREOF

BACKGROUND OF THE INVENTION

1. Field of the Invention

The present invention relates to a printing apparatus capable of printing on a plurality of types of sheets, and a control method thereof.

2. Description of the Related Art

An electrophotographic printing apparatus needs to apply heat and pressure to a sheet in order to fix, to the sheet, toner or ink transferred on it. For this purpose, the electrophotographic image forming apparatus includes a fixing unit for applying heat and pressure to a sheet and a conveyance mechanism for conveying a sheet to the fixing unit.

The amounts of heat and pressure necessary to fix toner or ink onto a sheet change depending on sheet characteristics such as the thickness and surface property of a sheet. The printing apparatus therefore requires a mechanism for changing the heating temperature of a sheet by the fixing unit, and control of the heating temperature of a sheet using a combination of fixing units. As a mechanism for performing appropriate fixing control in accordance with sheet characteristics, for example, Japanese Patent Laid-Open No. 07-072678 discloses a method of performing a printing process by setting a fixing unit to a set value at which toner or ink can be fixed to a sheet printed by a print job.

However, the conventional technique suffers the following problems. When successively printing on a plurality of sheets with different characteristics, the control of the fixing unit needs to be changed at the sheet switching timing. For example, the temperature of a fixing roller for heating a sheet needs to be changed in accordance with sheet characteristics. In this case, a standby time may be generated to change the temperature of the fixing unit, interrupting the printing process and decreasing the printing throughput.

Also, for example, when the fixing unit has the same settings for all types of sheets to be printed by a print job, an extra burden may be put on the fixing unit depending on a combination of sheet types. Further, the service life of the fixing unit may shorten. More specifically, when printing on sheets greatly different in characteristic (e.g., grammage) between former and latter pages of a print job, the same setting (e.g., the same fixing temperature) is applied to the entire job according to the conventional technique. Even when the burden on the fixing unit differs between the former and latter parts of the print job, all pages need to be printed using a setting which increases the burden. An unwanted burden is put on the fixing unit, so the service life of the fixing unit may shorten.

SUMMARY OF THE INVENTION

The present invention enables realization of a printing apparatus which executes appropriate fixing control complying with the type of printing material used in a printing process in consideration of the productivity of the printing process and the precision of fixing control, and a control method thereof.

One aspect of the present invention provides a printing apparatus comprising: an input unit that inputs a print job containing image data of a plurality of pages; a printing unit that includes a transfer unit transferring a developer to a printing material and a fixing unit fixing the transferred developer to the printing material, and executes a printing process for a plurality of types of printing materials based on the print job; an extraction unit that extracts a type of printing material used in the printing process based on the print job; a determination unit that, in a case where the extraction unit extracts a plurality of types, determines whether a set value common to the plurality of types of printing materials can be used for fixing control in the fixing unit when executing the printing process for the plurality of extracted types of printing materials; a decision unit that, in a case where the determination unit determines that the common set value can be used for the fixing control, decides a set value common to the plurality of types of printing materials used in the printing process based on the print job, and in a case where the determination unit determines that the common set value cannot be used for the fixing control, decides a plurality of set values for the respective types of printing materials used in the printing process based on the print job; and an execution unit that executes the fixing control in the fixing unit in accordance with the set value decided by the decision unit.

Another aspect of the present invention provides a method of controlling a printing apparatus comprising a printing unit that includes a transfer unit transferring a developer to a printing material and a fixing unit fixing the transferred developer to the printing material, and executes a printing process for a plurality of types of printing materials based on the print job, the method comprising: extracting a type of printing material used in the printing process based on the print job; in a case where a plurality of types are extracted in the extracting step, determining whether a set value common to the plurality of types of printing materials can be used for fixing control in the fixing unit when executing the printing process for the plurality of extracted types of printing materials; in a case where the common set value is determined in the determining step to be able to be used for the fixing control, deciding a set value common to the plurality of types of printing materials used in the printing process based on the print job, and in a case where the common set value is determined in the determining step not to be able to be used for the fixing control, deciding a plurality of set values for the respective types of printing materials used in the printing process based on the print job; and executing the fixing control in the fixing unit in accordance with the set value decided in the deciding step.

Further features of the present invention will be apparent from the following description of exemplary embodiments with reference to the attached drawings.

BRIEF DESCRIPTION OF THE DRAWINGS

FIG. 4 is a table showing the relationship between the sheet grammage and the temperature value of the fixing unit that should be set at the start of printing;

FIG. 5 is a table showing the relationship between set values of the fixing unit 115 based on the surface property of a sheet and the shape or material of a sheet;

FIG. 6 is a table showing the relationship between the sheet type and the grammage;

FIG. 16 is a view exemplifying the configurations of feeding devices capable of automatically changing a feeding device and feeding sheets when sheets stacked in the feeding device run out according to the third embodiment.

DESCRIPTION OF THE EMBODIMENTS

Embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

<Arrangement of Image Forming Apparatus>

Figure 1:
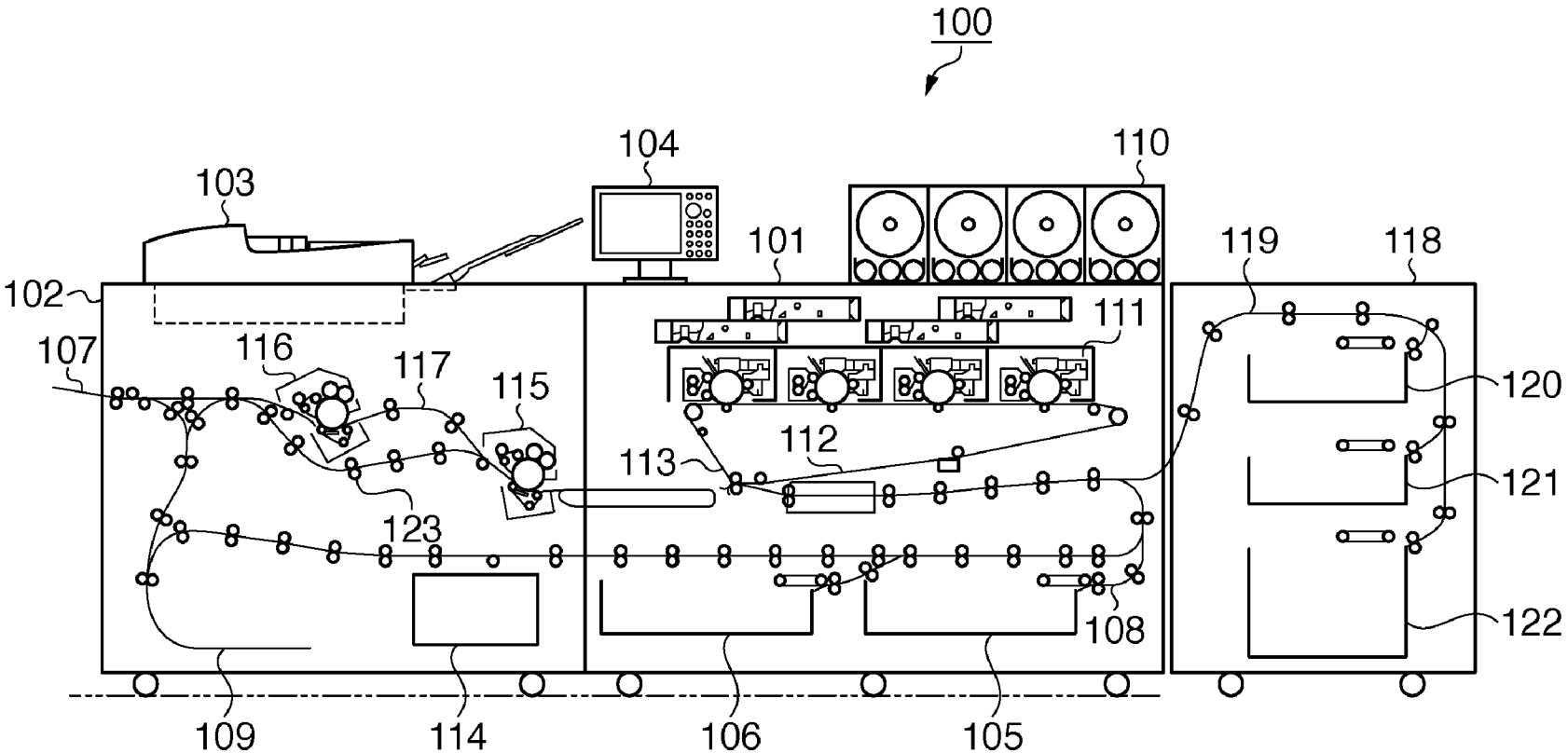
FIG. 1 is a sectional view exemplifying the arrangement of an image forming apparatus according to the present invention.

FIG. 1 is a sectional view exemplifying the arrangement of an image forming apparatus according to the present invention. A printing apparatus 100 will be explained as an example of the image forming apparatus. The image forming apparatus according to the present invention is applicable to an image forming apparatus having a fixing unit, such as a copying machine, facsimile apparatus, or multifunctional peripheral.

The printing apparatus 100 includes an image forming unit 101, fixing unit 102, scanner unit 103, operation unit 104, sheet discharge unit 107, toner supply unit 110, and external feeding device 118. The image forming unit 101 includes feeding devices 105 and 106, a conveyance unit 108, a primary transfer unit 111, a transfer belt 112, and a secondary transfer unit 113. The fixing unit 102 includes a switchback unit 109, a waste toner storage unit 114, fixing units 115 and 116, and conveyance units 117 and 123. The external feeding device 118 includes a conveyance unit 119, and feeding devices 120, 121, and 122.

The scanner unit 103 scans a document to generate digital data of an image. The operation unit 104 accepts various instructions from the user to the printing apparatus 100. The operation unit 104 includes hard keys and a display of the touch panel type or the like. The feeding devices 105, 106, 120, 121, and 122 stack sheets (printing materials) for printing by the printing apparatus 100. The sheet discharge unit 107 discharges a printed sheet outside the printing apparatus 100. In each conveyance unit, rollers are arranged at a predetermined interval to convey a sheet. The switchback unit 109 reverses the output surface of a sheet when discharging the sheet to the sheet discharge unit 107. The toner supply unit 110 supplies toner serving as a developer to the image forming unit 101. The primary transfer unit 111 transfers a toner image formed in accordance with image data onto the transfer belt 112. The secondary transfer unit 113 transfers the toner image from the transfer belt 112 to a sheet. The waste toner storage unit 114 stores wasteful toner generated during a transfer process. The fixing unit 115 applies heat and pressure to a sheet bearing an image at the secondary transfer unit 113, thereby fixing toner to the sheet. The fixing unit 116 enhances the fixation of the image by further applying heat and pressure to the sheet on which the image has been fixed by the fixing unit 115. The conveyance units 108, 117, 119, and 123 are conveyance paths for conveying a sheet. The conveyance unit 117 is a conveyance path for conveying a sheet from the fixing unit 115 to the fixing unit 116. The conveyance unit 123 is a conveyance path for conveying a sheet from the fixing unit 115 to the sheet discharge unit 107 or switchback unit 109 without the mediacy of the fixing unit 116. The conveyance units 108 and 119 are conveyance paths for supplying a sheet to the printing apparatus 100.

In the printing apparatus 100 according to the present invention, a plurality of devices having the same arrangement as that of the external feeding device 118 are sometimes connected to increase the number of sheet types to be successively switched during execution of a print job.

<Arrangement of Fixing Unit>

Figure 2:
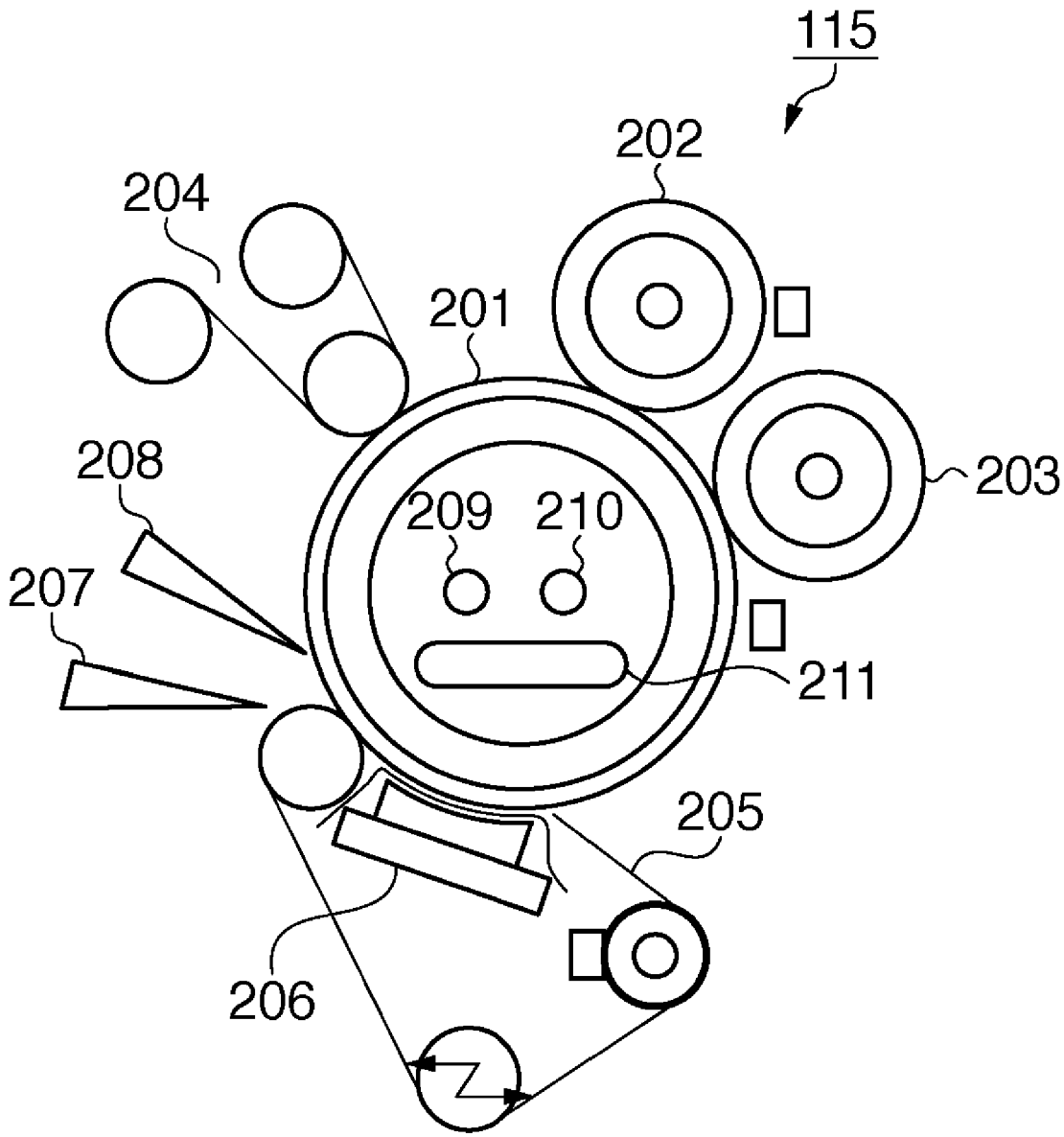
FIG. 2 is a view exemplifying the arrangement of a fixing unit 115 according to the present invention.

The fixing units 115 and 116 will be explained with reference to FIG. 2. FIG. 2 is a view exemplifying the arrangement of the fixing unit 115 according to the present invention. The arrangement of the fixing unit 116 is the same as that of the fixing unit 115, and a description thereof will not be repeated.

The fixing unit 115 includes a fixing roller 201, external heating rollers 202 and 203, a cleaning web 204, a conveyance belt 205, a press pad 206, and sheet separation grippers 207 and 208. The fixing roller 201 incorporates heaters 209 and 210 and a thermometer 211, and can apply heat to a passing sheet.

The external heating rollers 202 and 203 externally apply heat to the fixing roller 201. The cleaning web 204 is a cleaning device for removing toner adhered to the fixing roller 201. The conveyance belt 205 conveys a sheet which has reached the fixing unit 115, while bringing it into contact with the fixing roller 201. The press pad 206 applies pressure to a sheet in contact with the fixing roller 201. The sheet separation grippers 207 and 208 separate a sheet from the fixing roller 201. The thermometer 211 measures the temperature of the fixing roller 201. A main controller (to be described later) is notified of information measured by the thermometer 211. The fixing roller 201 and the external heating rollers 202 and 203 comprise mechanisms for independently adjusting the temperature, and can apply the amount of heat optimum for a sheet in accordance with the type of sheet to which an image is to be fixed. The printing apparatus 100 including the fixing units 115 and 116 can execute a printing process for a plurality of types of sheets.

<Control Arrangement of Printing Apparatus 100>

Figure 3:
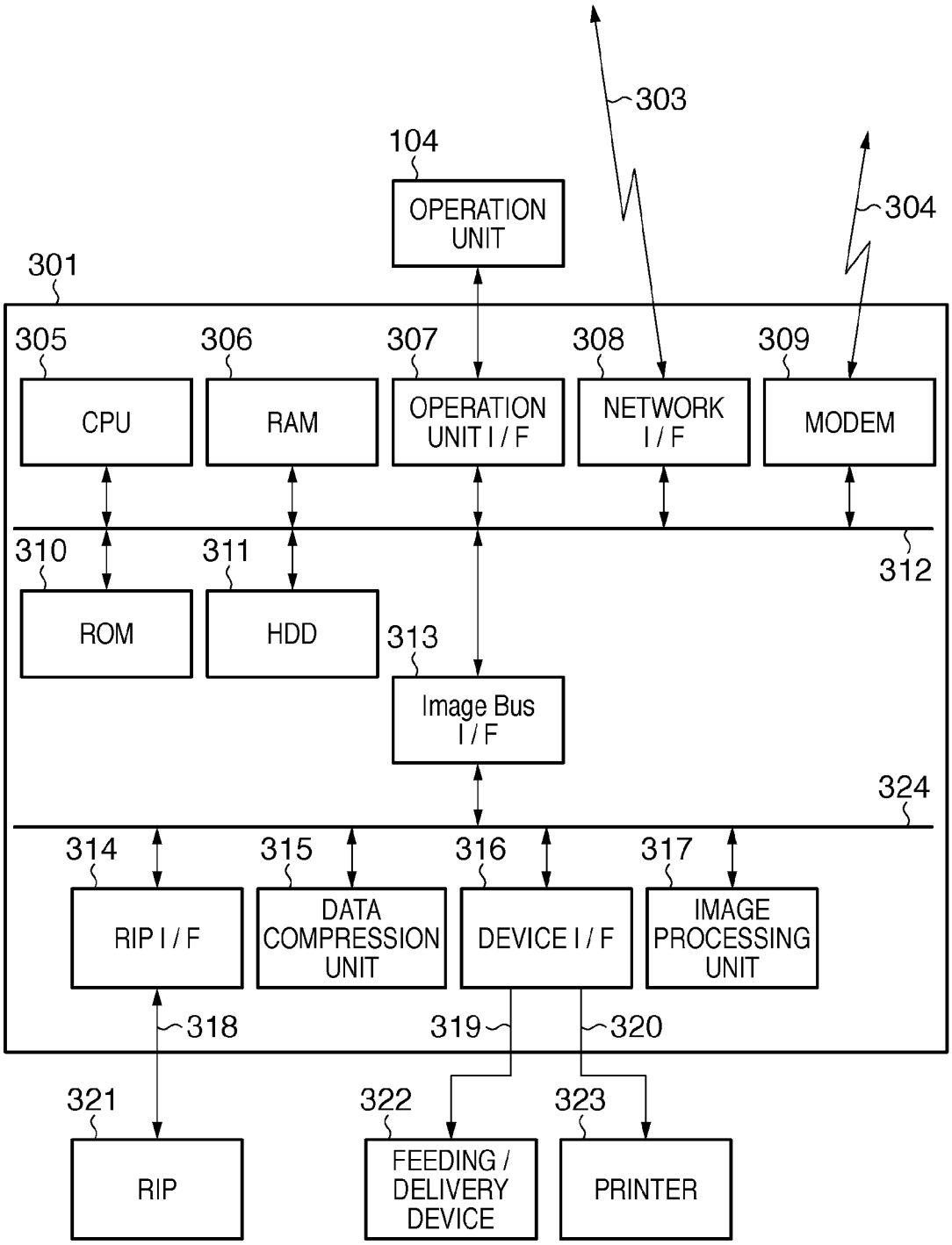
FIG. 3 is a block diagram showing a main controller 301 of a printing apparatus 100 according to the present invention.

The control arrangement of the printing apparatus 100 will be explained with reference to FIG. 3. FIG. 3 is a block diagram showing a main controller 301 of the printing apparatus 100 according to the present invention.

The main controller 301 includes a CPU 305, RAM 306, operation unit I/F 307, network I/F 308, modem 309, ROM 310, HDD 311, image bus I/F 313, RIP I/F 314, data compression unit 315, device I/F 316, and image processing unit 317. Reference numeral 312 denotes a CPU bus; 324, an image bus.

The network I/F 308 is connected to a network cable 303 for connecting an external device via a network. The modem 309 is connected to a line cable 304 for connecting an external device via a telephone line. The CPU 305 operates a program for controlling the overall main controller 301. The RAM 306 is managed by a program running on the CPU 305. The RAM 306 is used as a reception buffer for temporarily storing externally received data, an image data buffer for temporarily storing image data rasterized by a RIP 321, and the like. The ROM 310 stores programs running on the CPU 305, data, and the like. The HDD 311 is a nonvolatile storage device capable of saving various kinds of data for a long time.

The operation unit I/F 307 interfaces the operation unit 104 and main controller 301. The image bus I/F 313 interfaces the CPU bus 312 and image bus 324. The RIP I/F 314 is connected to the RIP 321 via a data bus 318. The RIP 321 is raster image processor (RIP) having a function of converting externally input image description data into bitmap image data. The RIP I/F 314 interfaces the RIP 321 and image bus 324 via the data bus 318. The data compression unit 315 compresses data.

The device I/F 316 is connected to a feeding/delivery device 322 via a data bus 319, and a printer 323 via a data bus 320. The printer 323 has the arrangement described with reference to FIG. 1. In accordance with a signal input from the operation unit 104 or an external device via the network cable 303, the CPU 305 issues an instruction to print to the printer 323 and feeding/delivery device 322 via the data buses 319 and 320. The image processing unit 317 executes various image processes for bitmap image data generated by the RIP 321. The image processing unit 317 has a function of digitally processing bitmap image data, such as a function of compositing bitmap image data of two pages into bitmap image data of one page.

FIG. 4 is a table showing the relationship between the grammage serving as a characteristic value representing a sheet characteristic and the temperature value of the fixing unit that should be set at the start of printing. In FIG. 4, reference numeral 401 denotes an upper limit value of the sheet grammage; 402, a lower limit value of it; and 403, an optimum temperature value of the fixing unit that corresponds to each grammage. The printing apparatus 100 according to the present invention holds, in the ROM 310 or the like in advance, a table which defines the information. At this time, the ROM 310 functions as a storage means.

Upon receiving a print job, the printing apparatus 100 extracts a sheet type used in the print job, and specifies the upper and lower limit values of the grammage based on the extracted sheet type. The print job is input from, for example, an external computer terminal connected via the network I/F 308. Also, the print job is input by, for example, scanning a document by the scanner unit 103. The print job contains image data of a plurality of pages. The print job also contains information representing the type of printing material used to execute a printing process when performing the printing process for image data of each page. By referring to the information shown in FIG. 4 that is stored in the ROM 310 or the like, the printing apparatus 100 decides a set value (fixing temperature) in fixing control that can be set commonly to sheet types used in the print job. In FIG. 4, the set value is defined in correspondence with the upper and lower limit values of the sheet grammage. However, the present invention is not limited to this, and the set value may be defined based on, for example, at least one of the surface property, shape, and material of a sheet. The temperature value of the fixing temperature is exemplified as the set value in fixing control. However, the present invention is not limited to this, and a set value including at least either of a temperature value for applying heat to a sheet and a pressure value for applying pressure to a sheet may be applied.

FIG. 5 is a table showing the relationship between set values of the fixing unit 115 based on the surface property of a sheet and the shape or material of a sheet. In FIG. 5, reference numeral 501 denotes a surface property of a sheet; 502, a shape or material of a sheet; and 503, execution/non-execution of fixing control at a set value of the fixing temperature shown in FIG. 4 that corresponds to the surface property of a sheet and the shape or material of a sheet. Note that the ROM 310 holds in advance the surface property of a sheet and the shape or material of a sheet as information accessory to the sheet type shown in FIG. 6 (to be described later). The printing apparatus 100 extracts the type of printing material used in a printing process from information contained in a print job. Then, by referring to FIG. 5 based on the surface property of a sheet and the shape or material of a sheet that correspond to the type of printing material, the printing apparatus 100 determines whether the set value of the fixing temperature in FIG. 4 is applicable. The set value of the fixing temperature in FIG. 4 is applicable to only a sheet which matches the surface property of a sheet and the shape or material of a sheet, as represented by ○ in 503.

FIG. 6 is a table showing the relationship between the sheet type and the grammage. For example, when the sheet type is plain paper, the grammage of plain paper has a lower limit value of 80 g/m$^2$ and an upper limit value of 100 g/m$^2$. FIG. 6 shows a correspondence when the user assigns a name to a grammage range to easily recognize a sheet type. Reference numeral 601 denotes a sheet type (printing medium type); and 602, a grammage. The operation unit 104 displays the character string of the printing medium type 601 shown in FIG. 6. Reference numeral 603 denotes the fixing temperature of each sheet type. When no common fixing temperature is applicable to a plurality of types of sheets using the table of FIG. 4, the fixing units 115 and 116 are controlled at a fixing temperature in 603.

<First Embodiment>

Figure 7:
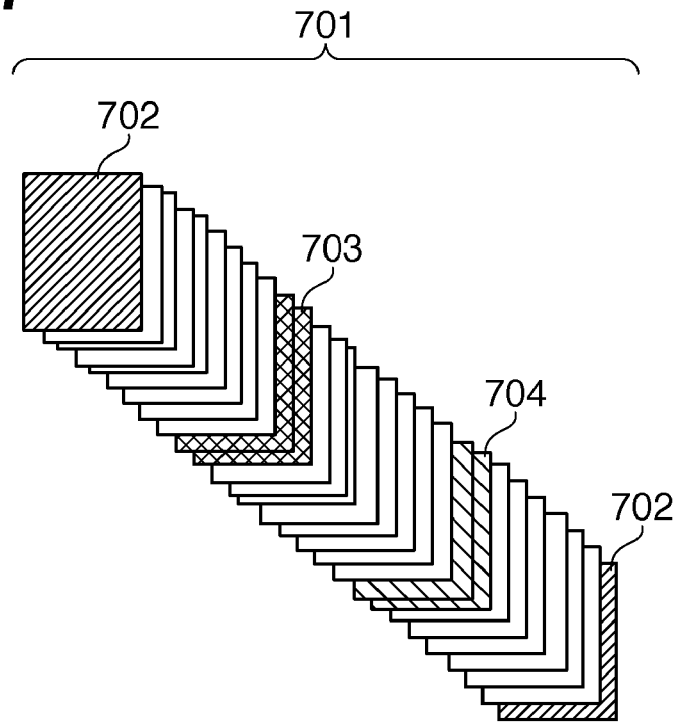
FIG. 7 is a view exemplifying a print job using a plurality of types of sheets with different characteristics.

The first embodiment will now be described with reference to FIGS. 7 to 10. The first embodiment will explain a fixing temperature setting method when a print job is input to start a printing process based on the print job, and a fixing temperature setting method when resuming interrupted printing. FIG. 7 is a view exemplifying a print job using a plurality of types of sheets with different characteristics. Reference numeral 701 denotes a print job representing all sheets to be printed. Reference numeral 702 denotes sheets which are inserted first and last and are different in sheet type from the body. Reference numerals 703 and 704 denote sheets which are inserted into the body and are different in sheet type from the body. Sheets except for the sheets 702, 703, and 704 are those printed as the body of the print job, and all of them are of the same sheet type. The print job contains image data of the respective pages of the print job 701 and information representing the sheet type of each page. As information accessory to the information representing a sheet type, the print job further contains information representing the surface property and shape (or material) of a sheet. For example, for a print job containing image data of two pages, the sheet type of the first page is thick paper 1 shown in FIG. 6. As information accessory to thick paper 1, information representing that the surface property is "one-side coated" and the shape is normal is appended. Further, the sheet type of the second page is thick paper 2 shown in FIG. 6. As information accessory to thick paper 2, information representing that the surface property is normal and the shape is a tab is appended. An HDD 311 stores the print job 701.

Figure 8:
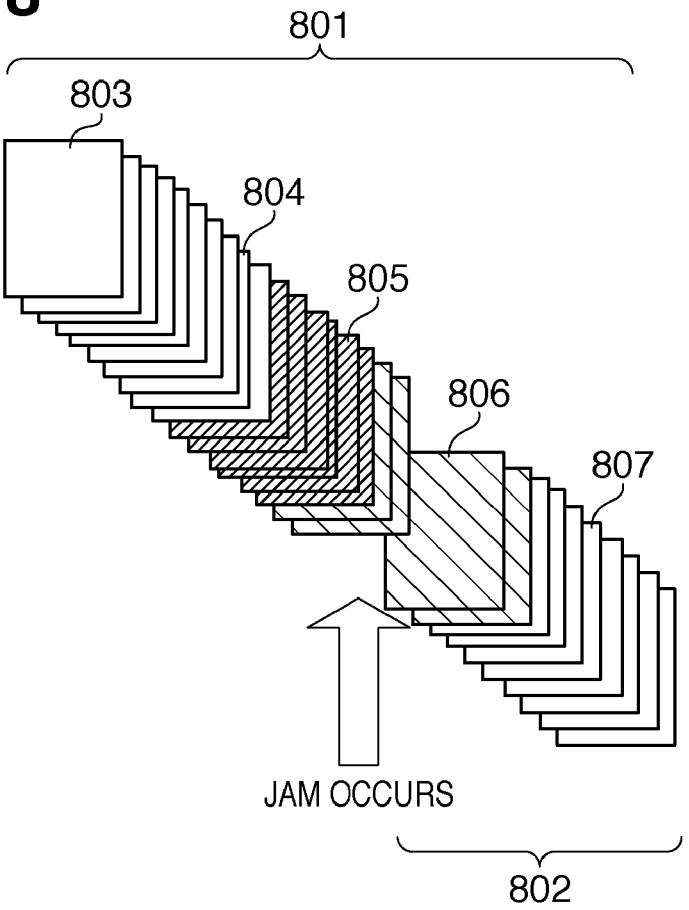
FIG. 8 is a view showing a state in which a jam occurs to interrupt printing in a print job using a plurality of types of sheets.

FIG. 8 is a view showing a state in which a jam occurs to interrupt printing in a print job using a plurality of types of sheets. Reference numeral 801 denotes a print job representing all sheets to be printed. Reference numeral 802 denotes all sheets to be printed after resuming interrupted printing. Reference numerals 803 to 807 denote different types of sheets. In the first embodiment, at the start of a printing process based on a print job, a set value (temperature value) of fixing units 115 and 116 that corresponds to the sheets 803 to 807 is applied. However, when resuming the printing process after it is interrupted owing to a jam, a set value of the fixing units 115 and 116 that corresponds to the sheets 806 and 807 is applied.

<Fixing Control>

Figure 9:
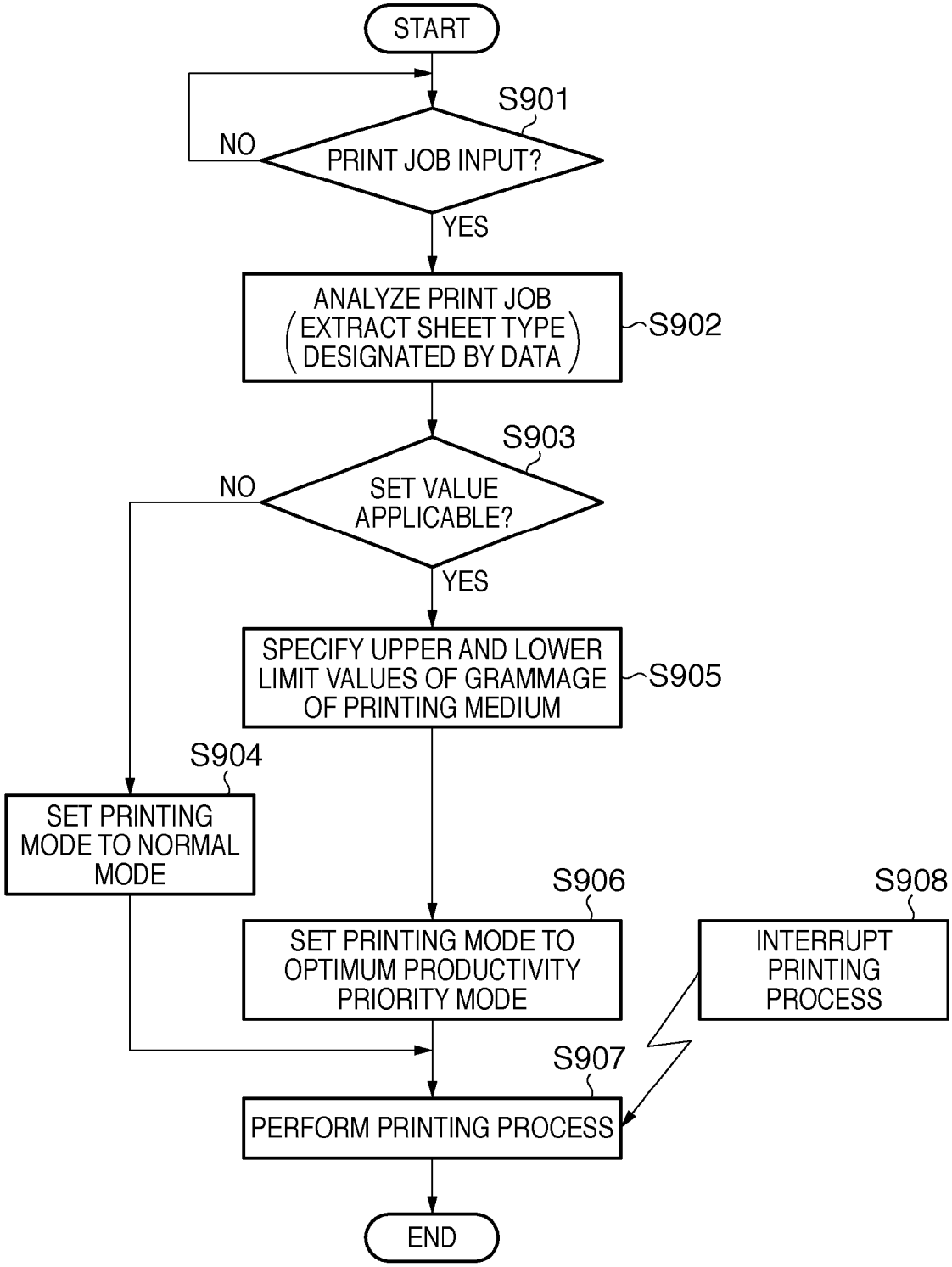
FIG. 9 is a flowchart showing the control procedures of fixing control according to the first embodiment.

Details of fixing control according to the first embodiment will be described with reference to FIGS. 9 and 10. FIG. 9 is a flowchart showing the control procedures of fixing control according to the first embodiment. A CPU 305 implements the following process by executing a program stored in a ROM 310. To explain the first embodiment, a print job requiring a plurality of types of sheets is assumed to be executed.

When a printing apparatus 100 is turned on and a process to start up each unit of the printing apparatus 100 is completed, the printing apparatus 100 shifts to a print job input standby state in step S901. In step S901, the CPU 305 determines whether a print job has been input. If a print job has been input, the process advances to step S902.

In step S902, the CPU 305 analyzes the print job input in step S901. In the analysis process, the CPU 305 extracts information representing the types of all sheets used in a printing process based on the input print job, and information (information representing the surface property and shape of a sheet) accessory to the sheet type. More specifically, the CPU 305 analyzes the print job stored in the HDD 311, and extracts information which specifies a sheet type used when performing a printing process for each page contained in the print job. Subsequently in step S903, if pieces of information each representing a sheet type have been extracted, the CPU 305 determines whether a set value for controlling the fixing units 115 and 116 can be one common to all the sheets used in the print job. More specifically, the CPU 305 determines whether a set value common to all the sheets is applicable, based on the information accessory to the sheet type that has been extracted in step S902, and the table of FIG. 5 representing whether fixing control is applicable in accordance with the surface property and shape/material of a sheet. For example, when the CPU 305 extracts, as the information accessory to the sheet type, information representing that the surface property is normal and the shape is a tab and information representing that the surface property is "one-side coated" and the shape is normal, FIG. 5 shows ○ for both the combinations. Thus, the CPU 305 determines that a common set value is applicable. In contrast, when the CPU 305 extracts, as the information accessory to the sheet type, information representing that the surface property is normal and the shape is a tab and information representing that the surface property is "two-side coated" and the shape is normal, FIG. 5 shows x for the latter combination. The CPU 305 therefore determines that no common set value is applicable.

When only a piece of information representing a sheet type is extracted, the process advances to step S904. When a common set value is applicable based on the extraction result of information accessory to the sheet type and the table of FIG. 5 representing whether fixing control is applicable in accordance with the surface property and shape/material of a sheet, the CPU 305 uses the tables of FIGS. 4 and 6 to further determine whether a common set value is applicable. More specifically, the CPU 305 specifies a grammage range by referring to FIG. 6 based on the information which has been extracted in step S902 and represents the sheet type.

For example, when plain paper and thick paper 1 are extracted as sheet types, 80 to 105 g/m$^2$ is specified as the grammage range of plain paper, and 106 to 128 g/m$^2$ is specified as that of thick paper 1. By looking up the table of FIG. 4, the fixing temperature is referred from the upper limit value (128 g/m$^2$) and lower limit value (80 g/m$^2$) of the grammage. In this case, 210° C. is calculated as the fixing temperature, and the CPU 305 determines that 210° C. is applicable as a common set value.

For example, when plain paper and thick paper 6 are extracted as sheet types, 80 to 105 g/m$^2$ is specified as the grammage range of plain paper, and 257 to 300 g/m$^2$ is specified as that of thick paper 6. By looking up the table of FIG. 4, the fixing temperature is referred from the upper limit value (300 g/m$^2$) and lower limit value (80 g/m$^2$) of the grammage. In this case, no fixing temperature can be calculated (x in the table of FIG. 4), so the CPU 305 determines that 210° C. is not applicable as a common set value. The table of FIG. 4 shows x when the upper and lower limit values of the grammage greatly differ from each other. In this case, fixing control at a common fixing temperature may degrade a printed material or shorten the service life of the fixing unit. The degradation of a printed material and the shortening of the service life of the fixing unit can be prevented by inhibiting application of a common set value to a combination of sheet types for which the table of FIG. 4 shows x.

If the CPU 305 determines in step S903 that no common set value is applicable, it advances to step S904; if it determines that a common set value is applicable, to step S905.

In step S904, the CPU 305 makes, for the fixing units 115 and 116, a setting, which is not used for a plurality of types of sheets, and then advances to step S907. That is, for each sheet type used in the print job, a corresponding set value is applied in fixing control. For example, when plain paper and thick paper 6 are extracted as sheet types in step S902, 200° C. shown in FIG. 6 is set as the set value of the fixing temperature when printing on a sheet of plain paper. When printing on a sheet of thick paper 6, 220° C. shown in FIG. 6 is set as the set value of the fixing temperature. In this case, importance is placed on the fixing control precision rather than the productivity. For descriptive convenience, this setting is defined as a normal mode.

In step S905, the CPU 305 specifies, from the table of FIG. 6 based on the information that has been extracted in step S902 and specifies a sheet type, the upper and lower limit values of a grammage corresponding to the sheet type designated by the print job. In step S906, the CPU 305 decides the set value of the fixing units 115 and 116 based on the upper and lower limit values of the sheet grammage that have been specified in step S905, and the table of FIG. 4 representing the relationship between the upper and lower limit values of the sheet grammage and the set value of the fixing temperature. For example, when plain paper and thick paper 1 are extracted as sheet types, 80 to 105 g/m$^2$ is specified as the grammage range of plain paper, and 106 to 128 g/m$^2$ is specified as that of thick paper 1. By looking up the table of FIG. 4, 210° C. is decided as the set value of the fixing temperature in accordance with the upper limit value (128 g/m$^2$) and lower limit value (80 g/m$^2$) of the grammage. That is, a set value in fixing control that is common to a plurality of types of sheets used in the print job is applied. In this case, importance is placed on the productivity rather than the fixing control precision. For descriptive convenience, this setting is defined as a productivity priority mode.

In step S907, based on the set value decided in step S904 or S906, the CPU 305 controls the fixing units 115 and 116 to execute a printing process.

When a set value of the fixing temperature that is common to a plurality of types of sheets is applied in step S906, the CPU 305 controls the temperatures of the fixing units 115 and 116 of a printer 323 to the set temperature. When the temperatures of the fixing units 115 and 116 reach the set fixing temperature, the CPU 305 starts a printing process based on the print job. In this case, even when the printing process based on the print job uses a plurality of types of sheets, fixing control can be executed at a fixing temperature common to them, so no fixing temperature need be changed during execution of the printing process. For this reason, no idle time is generated by temporal interruption of the printing process to change the fixing temperature (e.g., the printing process waits until the temperature of the fixing unit drops to decrease the fixing temperature).

When the set value of the fixing temperature is applied for each sheet type used in the print job in step S904, the CPU 305 controls the temperatures of the fixing units 115 and 116 of the printer 323 to a fixing temperature corresponding to the sheet type to undergo the printing process. For example, when printing five pages using plain paper and then five pages using thick paper 6, 200° C. shown in FIG. 6 is set as the set value of the fixing temperature in a printing process for sheets of plain paper, and 220° C. shown in FIG. 6 is set as the set value of the fixing temperature in a printing process for sheets of thick paper 6. In this case, when the temperatures of the fixing units 115 and 116 reach 200° C., the CPU 305 starts a printing process based on the print job. After the end of the printing process for five pages of the first half, the CPU 305 changes the set value of the fixing temperature to 220° C. in order to perform a printing process for sheets of thick paper 6. In this case, the printing process is temporarily interrupted to change the fixing temperature. When the thermistor (not shown) of the fixing unit detects that the fixing temperature has reached 220° C., the CPU 305 resumes the interrupted printing process.

Step S908 in FIG. 9 represents interruption of printing that occurs during execution of step S907. For example, when a jam occurs in sheet conveyance during printing, an interruption in step S908 occurs. If the interruption in step S908 occurs, an interruption process shown in FIG. 10 is executed.

Figure 10:
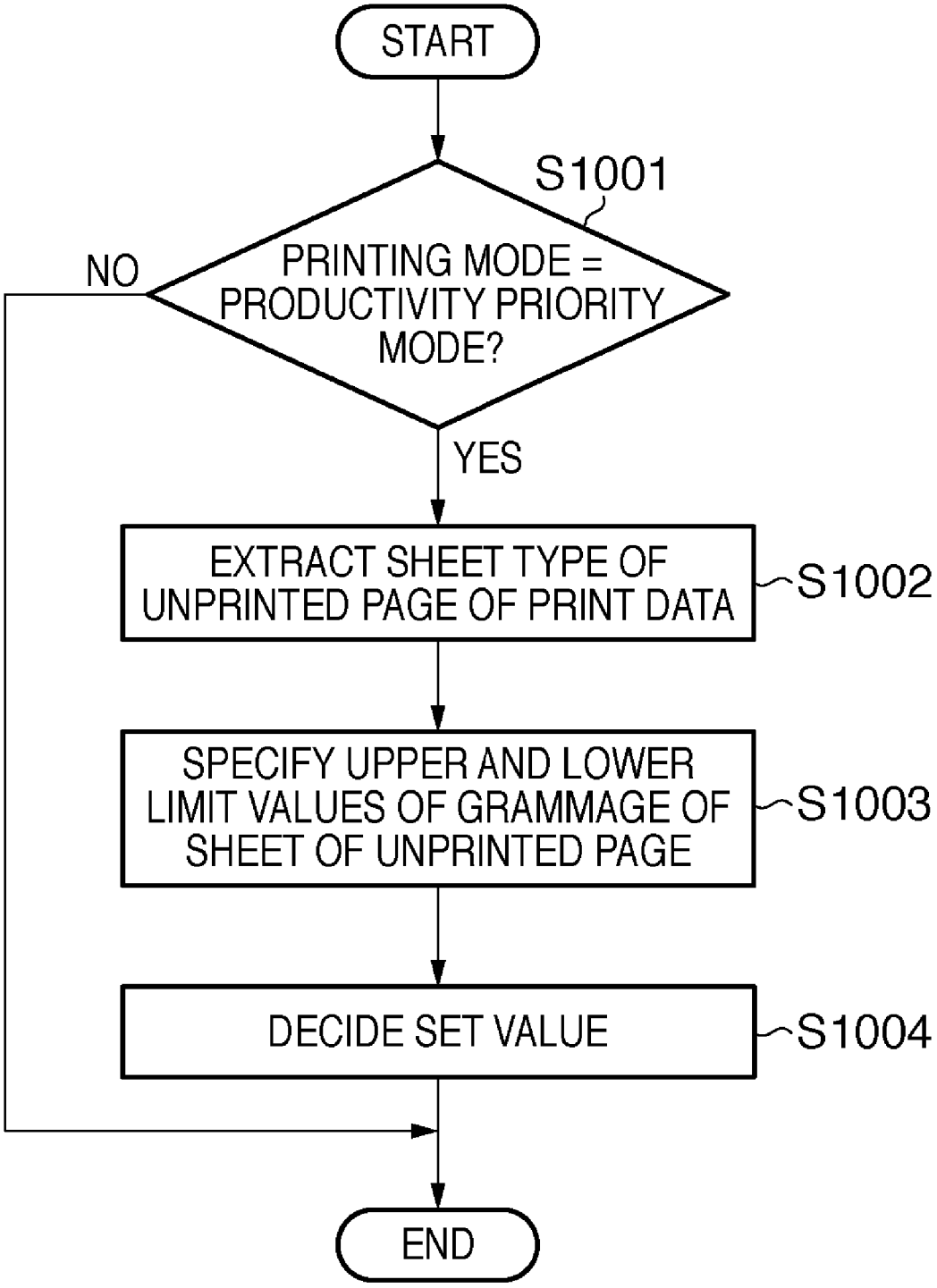
FIG. 10 is a flowchart showing the control procedures of an interruption process generated during a printing process according to the first embodiment.

FIG. 10 is a flowchart showing the control procedures of the interruption process generated during the printing process according to the first embodiment. The CPU 305 implements the following process by executing a program stored in the ROM 310. The following process is executed when step S908 of FIG. 9 occurs.

After the start of the interruption process, the CPU 305 determines in step S1001 whether the printing mode is the productivity priority mode. If the printing mode is the productivity priority mode, the process advances to step S1002; if it is the normal mode, the interruption process ends.

In step S1002, the CPU 305 extracts information which specifies a sheet type not undergoing a printing process yet among all sheet types which have been extracted in step S902 of FIG. 9 and are used in the printing process based on the print job. In step S1003, based on the extracted information which specifies a sheet type, the CPU 305 specifies, from the table of FIG. 6, the upper and lower limit values of a sheet grammage corresponding to the sheet type. In step S1004, the CPU 305 decides the set value of the fixing units 115 and 116 based on the specified upper and lower limit values of the sheet grammage, and the table of FIG. 4 representing the relationship between the upper and lower limit values of the sheet grammage and the set value of the fixing temperature. When this interruption process is executed to resume the printing process in step S907 of executing a printing process, the CPU 305 controls the fixing units 115 and 116 based on the set value decided in step S1004.

As described above, upon receiving a print job, the image forming apparatus according to the first embodiment extracts a sheet type for use. If a plurality of types are extracted, the image forming apparatus determines whether a set value common to the extracted sheet types can be used for fixing control in the fixing unit. If a common set value can be used for the fixing control, the image forming apparatus decides a common set value. If no common set value can be used for the fixing control, the image forming apparatus decides a set value for each type. In accordance with the decided set value, the image forming apparatus executes the fixing control in the fixing unit. Further, when execution of a printing process is interrupted and the set value before the interruption is a common one, the image forming apparatus extracts sheet types which have not been printed upon the interruption, decides a common set value corresponding to the extracted sheet types, and resumes the printing process. In this way, the image forming apparatus according to the first embodiment decides a set value (e.g., temperature value or pressure value) in fixing control in accordance with a combination of sheet types used in a print job while taking account of the productivity or fixing control precision. The image forming apparatus can achieve fixing control which minimizes a decrease in productivity and the burden on the fixing unit. The image forming apparatus decides an optimum set value again upon interrupting a printing process, and thus can perform more effective fixing control.

<Second Embodiment>

The second embodiment will be explained with reference to FIGS. 11 to 14. The second embodiment will explain a fixing temperature setting method considering a page having undergone a print job analysis process upon completion of printing preparation of a printer.

In the first embodiment, all sheets to be printed by a print job are extracted and then the set value of the fixing unit is decided based on the sheet types. In the first embodiment, an analysis process needs to be completed for all print data prior to a printing process by the printing unit. Even if a printing process by the printing unit is possible during analysis of print data, execution of the printing process has to wait for the completion of the print data analysis process, generating a standby time till the start of printing and decreasing the productivity. The second embodiment solves this problem.

Figure 11:
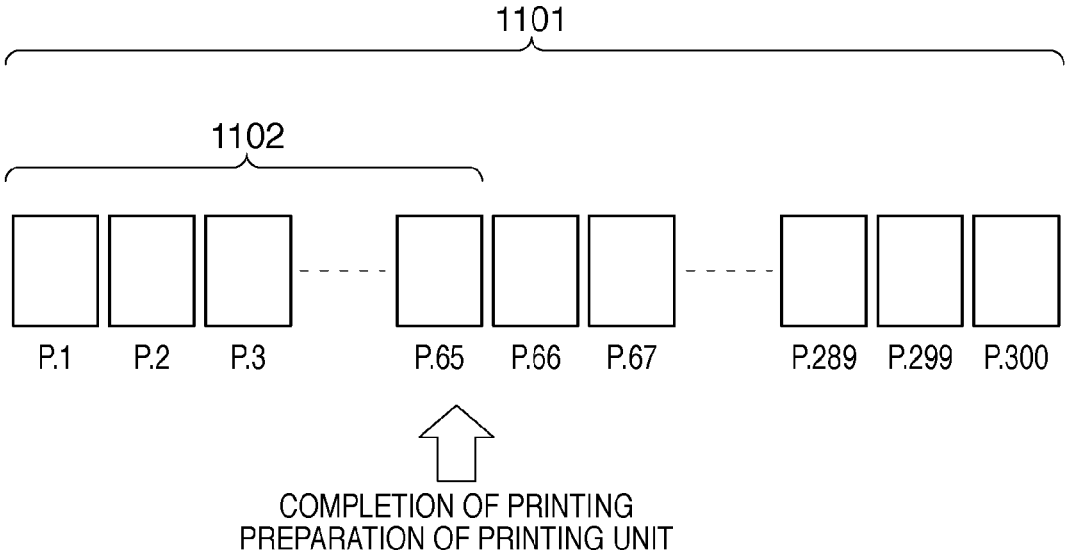
FIG. 11 is a view exemplifying a job using a plurality of types of sheets with different characteristics.

FIG. 11 is a view exemplifying a print job using a plurality of types of sheets with different characteristics. Reference numeral 1101 denotes a print job representing all sheets to be printed. Reference numeral 1102 denotes pages having undergone an analysis process upon completion of printing preparation of a printer 323. FIG. 11 shows that the analysis process is completed for 65 pages out of 300 pages to be printed by the print job upon completion of printing preparation of the printer 323.

Figure 12:
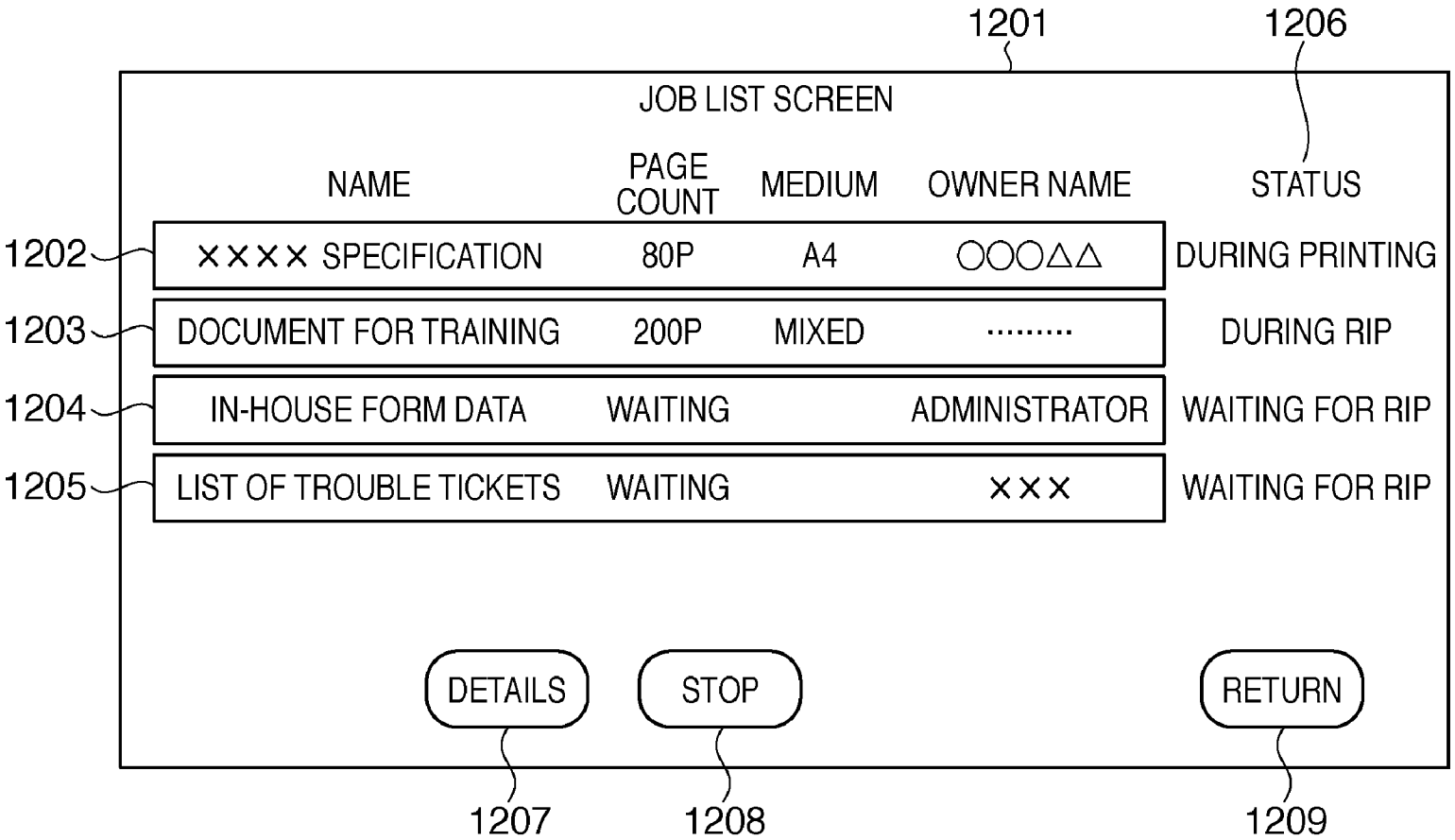
FIG. 12 is a view exemplifying a screen 1201 which displays the processing status of a job on an operation unit 104 according to the second embodiment.

FIG. 12 is a view exemplifying a screen 1201 which displays the processing status of a job on an operation unit 104 according to the second embodiment. As shown in FIG. 12, the screen 1201 displays job lists 1202 to 1205, a processing status 1206, and buttons 1207 to 1209.

The job lists 1202 to 1205 are lists of print jobs during processing by a printing apparatus 100. The list of each print job shows a job name, processed page count, the size of sheets to be printed by the print job, and the owner name of the print job. The processing status 1206 is a display portion representing the processing status of each print job during processing by the printing apparatus 100. There are four job processing statuses, for example, "during printing", "waiting for printing", "during RIP", and "waiting for RIP".

In the second embodiment, when printing preparation of the printer 323 starts during RIP of a print job, RIP and a printing process are parallel-executed for the print job. The button 1207 is used to confirm the detailed statuses of print jobs in the job lists 1202 to 1205. The user can confirm details of a desired print job by selecting it from the job lists 1202 to 1205 and pressing the button 1207. The button 1208 is used to stop a selected print job. The button 1209 is used to end the screen 1201 representing the job processing status.

<Fixing Control>

Figure 13:
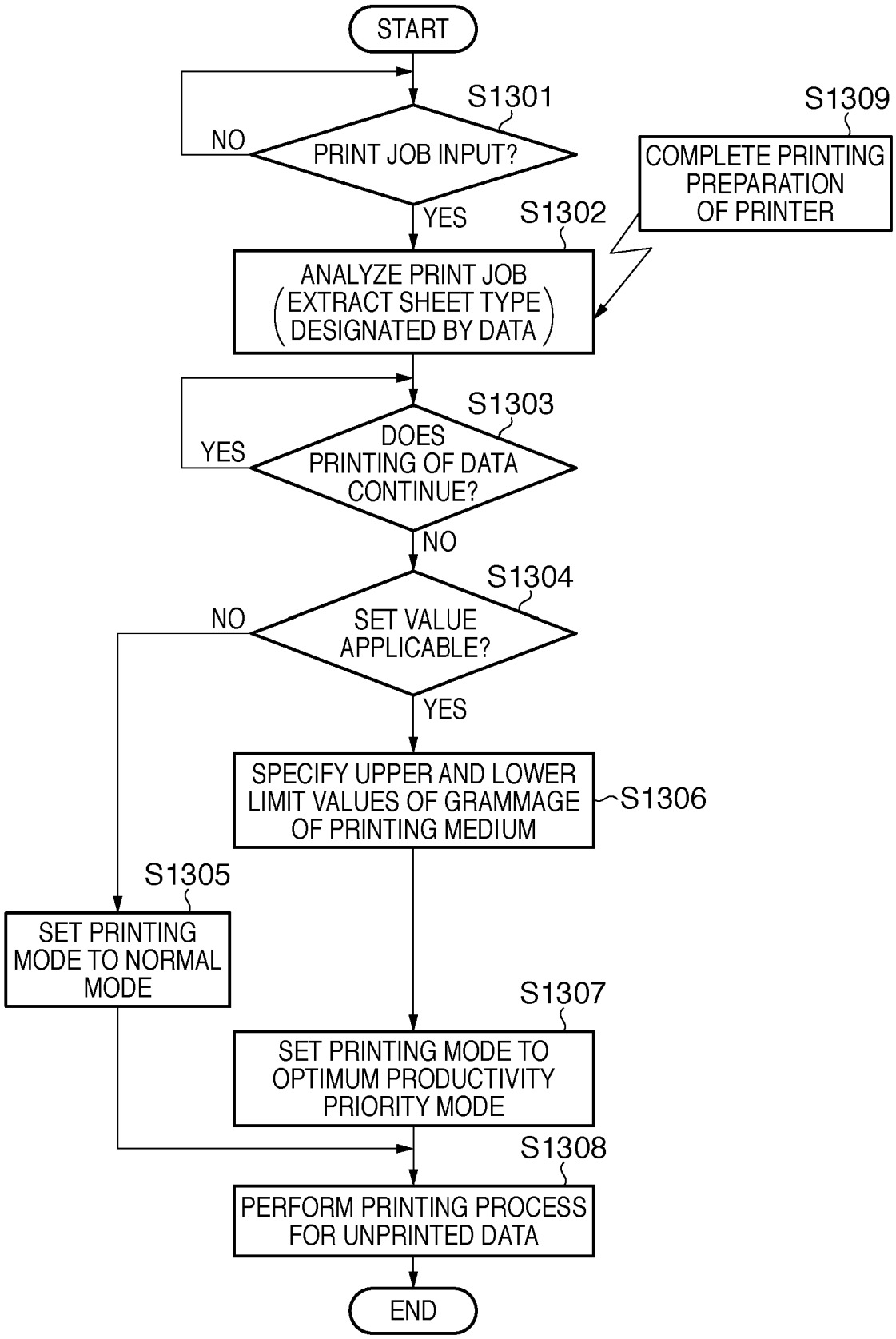
FIG. 13 is a flowchart showing the control procedures of fixing control according to the second embodiment.

FIG. 13 is a flowchart showing the control procedures of fixing control according to the second embodiment. A CPU 305 implements the following process by executing a program stored in a ROM 310. To explain the second embodiment, a plurality of print jobs are assumed to simultaneously exist in the printing apparatus 100. The second embodiment can be effectively applied particularly to a state in which a preceding job is during printing and has undergone a RIP process, as represented by the job list 1203.

When the printing apparatus 100 is turned on and a process to start up each unit of the printing apparatus 100 is completed, the printing apparatus 100 shifts to a print job input standby state in step S1301. In step S1301, the CPU 305 determines whether a print job has been input. If a print job has been input, the process advances to step S1302.

In step S1302, the CPU 305 analyzes the input print job. In the analysis process, the CPU 305 extracts information representing the types of all sheets used in a printing process based on the input print job, and information (information representing the surface property and shape of a sheet) accessory to the sheet type. More specifically, the CPU 305 analyzes the print job stored in an HDD 311, and extracts information which specifies a sheet type used when performing a printing process for each page contained in the print job. During the process of step S1302, interruption step S1309 may occur to notify the completion of printing preparation from the printer 323. Upon generation of step S1309, an interruption process in FIG. 14 (to be described later) starts.

After the end of the print job analysis process, the CPU 305 determines in step S1303 whether a printing process based on the print job input in step S1301 has already started. If a printing process based on the print job input in step S1301 has already started, the process is suspended till the end of the printing process.

When pieces of information each representing a sheet type have been extracted, the CPU 305 determines in step S1304 whether a set value for controlling fixing units 115 and 116 can be one common to all the sheets used in the print job. More specifically, the CPU 305 determines whether a set value common to all the sheets is applicable, based on the information accessory to the sheet type that has been extracted in step S1302, and the table of FIG. 5 representing whether fixing control is applicable in accordance with the surface property and shape/material of a sheet. When only a piece of information representing a sheet type is extracted, the process advances to step S1305. When a common set value is applicable based on the extraction result of information accessory to the sheet type and the table of FIG. 5 representing whether fixing control is applicable in accordance with the surface property and shape/material of a sheet, the CPU 305 uses the tables of FIGS. 4 and 6 to further determine whether a common set value is applicable. The determination process in step S1304 is the same as that in foregoing step S903, and a description thereof will not be repeated. If the CPU 305 determines in step S1304 that no common set value is applicable, it advances to step S1305; if it determines that a common set value is applicable, to step S1306.

In step S1305, the CPU 305 sets the set value of the fixing units 115 and 116 to a value not corresponding to a plurality of types of sheets, and then shifts to step S1308. That is, for each sheet type used in the print job, a corresponding set value is applied in fixing control. In this case, importance is placed on the fixing control precision rather than the productivity. For descriptive convenience, this setting is defined as a normal mode.

In step S1306, the CPU 305 specifies, based on the print data sheet information extracted in step S1302, upper and lower limit values among the grammages of a plurality of types of sheets designated by the print job. In step S1307, the CPU 305 decides the set value of the fixing units 115 and 116 based on the specified upper and lower limit values of the sheet grammage, and the table of FIG. 4 representing the relationship between the upper and lower limit values of the sheet grammage and the set value of the fixing temperature. That is, a set value in fixing control that is common to a plurality of types of sheets used in the print job is applied. In this case, importance is placed on the productivity rather than the fixing control precision. For descriptive convenience, this setting is defined as a productivity priority mode.

In step S1308, based on the set value decided in step S1305 or S1307, the CPU 305 controls the fixing units 115 and 116 to execute a printing process for unprinted data. A printing process when a common set value of the fixing temperature is applied to a plurality of types of sheets and a printing process when a corresponding set value of the fixing temperature is applied to each sheet type used in a print job are the same as those described in the first embodiment, and a description thereof will not be repeated.

Figure 14:
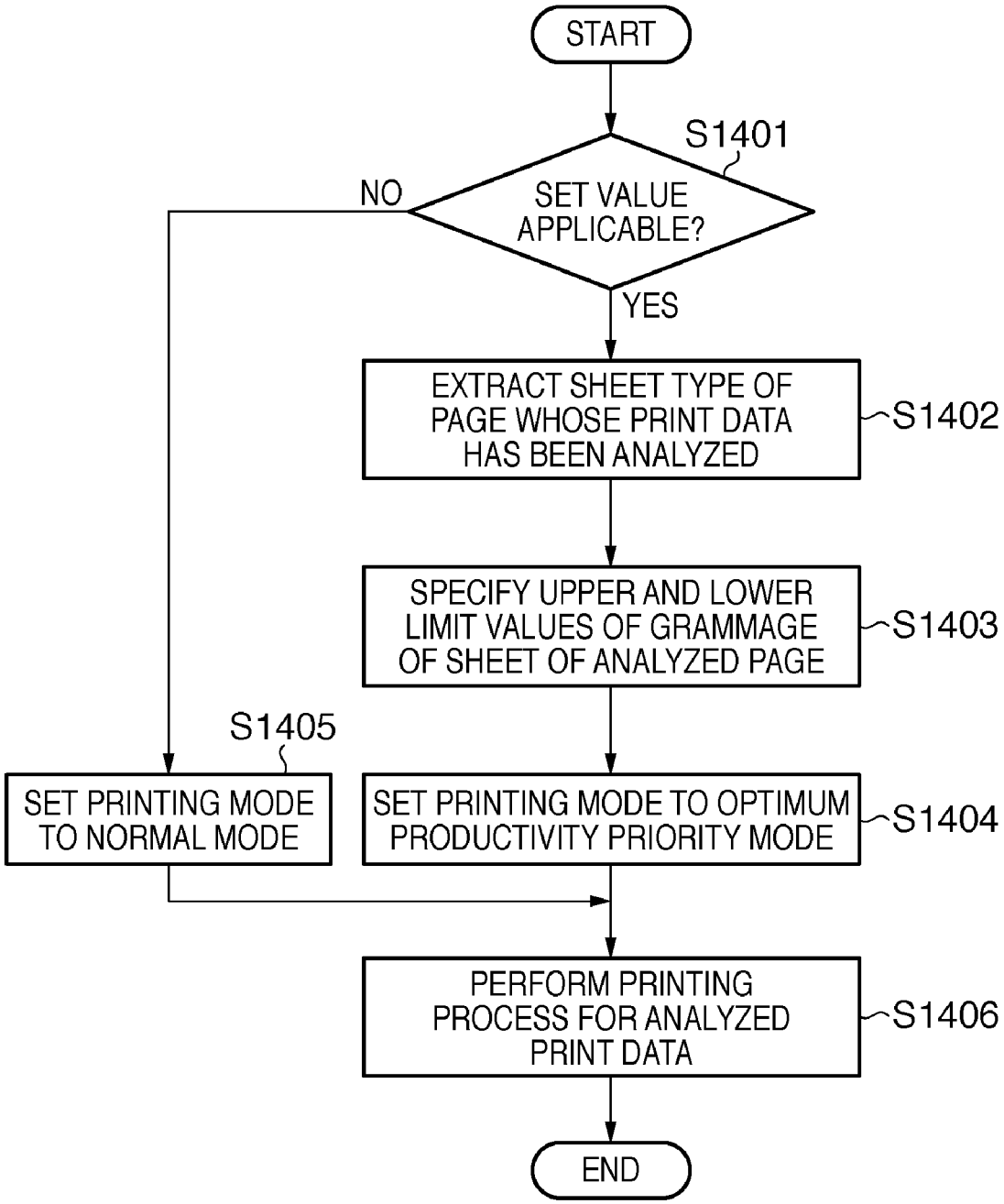
FIG. 14 is a flowchart showing the control procedures of an interruption process upon completion of preparation of a printer according to the second embodiment.

FIG. 14 is a flowchart showing the control procedures of the interruption process upon completion of preparation of the printer according to the second embodiment. The CPU 305 implements the following process by executing a program stored in the ROM 310. The following process is executed when step S1309 of FIG. 13 occurs.

After the start of the interruption process, in step S1401, the CPU 305 executes the same printing mode determination process as step S1304 of FIG. 13. If a set value common to all sheets is not applicable, the process advances to step S1405; if it is applicable, to step S1402.

In step S1405, the CPU 305 makes, for the fixing units 115 and 116, a setting, which is not used for a plurality of types of sheets, and then advances to step S1406. That is, for each sheet type used in the print job, a corresponding set value is applied in fixing control. In this case, importance is placed on the fixing control precision rather than the productivity. For descriptive convenience, this setting is defined as a normal mode.

In step S1402, the CPU 305 extracts information which specifies a sheet type designated by the print job analyzed in step S1302 of FIG. 13. In step S1403, based on the extracted information which specifies a sheet type, the CPU 305 specifies, from the table of FIG. 6, the upper and lower limit values of a grammage corresponding to the sheet type designated by the print job. In step S1404, the CPU 305 decides the set value of the fixing units 115 and 116 based on the specified upper and lower limit values of the sheet grammage, and the table of FIG. 4 representing the relationship between the upper and lower limit values of the sheet grammage and the set value of the fixing temperature. That is, a set value in fixing control that is common to a plurality of types of sheets used in the print job is applied. In this case, importance is placed on the productivity rather than the fixing control precision. For descriptive convenience, this setting is defined as a productivity priority mode.

In step S1406, the CPU 305 controls the fixing units 115 and 116 based on the set value decided in step S1404 or S1405. The CPU 305 then starts a printing process for print data analyzed in step S1302 of FIG. 13.

As described above, upon receiving a print job, the image forming apparatus according to the second embodiment extracts a sheet type for use. If a plurality of types are extracted, the image forming apparatus determines whether a set value common to the extracted sheet types can be used for fixing control in the fixing unit. If a common set value can be used for the fixing control, the image forming apparatus decides a common set value. If no common set value can be used for the fixing control, the image forming apparatus decides a set value for each type. In accordance with the decided set value, the image forming apparatus executes the fixing control in the fixing unit. Further, when preparation of the printer is completed during extraction of a sheet type, the image forming apparatus decides a set value for only sheet types which have been extracted at that time, and executes a printing process. In this manner, the image forming apparatus according to the second embodiment decides a set value (e.g., temperature value or pressure value) in fixing control in accordance with a combination of sheet types used in a print job while taking account of the productivity or fixing control precision. The image forming apparatus can achieve fixing control which minimizes a decrease in productivity and the burden on the fixing unit. If the printing preparation is completed during extraction of a sheet type, the image forming apparatus executes a printing process ahead with only a sheet, the type of which has been extracted. The image forming apparatus can therefore perform fixing control at higher productivity. The second embodiment may be applied in combination with the first embodiment.

<Third Embodiment>

The third embodiment will be explained with reference to FIGS. 15 to 17. The third embodiment will explain a fixing temperature setting method considering the possibility that the paper cassette is switched.

When a function of automatically changing a sheet upon running out of sheets during printing is valid, printing may be done by selecting a sheet type not assumed at the start of a job. In this case, the sheet not assumed at the start of a job may fall outside the range of the set value of the fixing unit. At the timing of switching to this sheet, a standby time may be generated upon a change of the set value of the fixing unit, decreasing the productivity in continuous printing. The third embodiment solves this problem.

Figure 15:
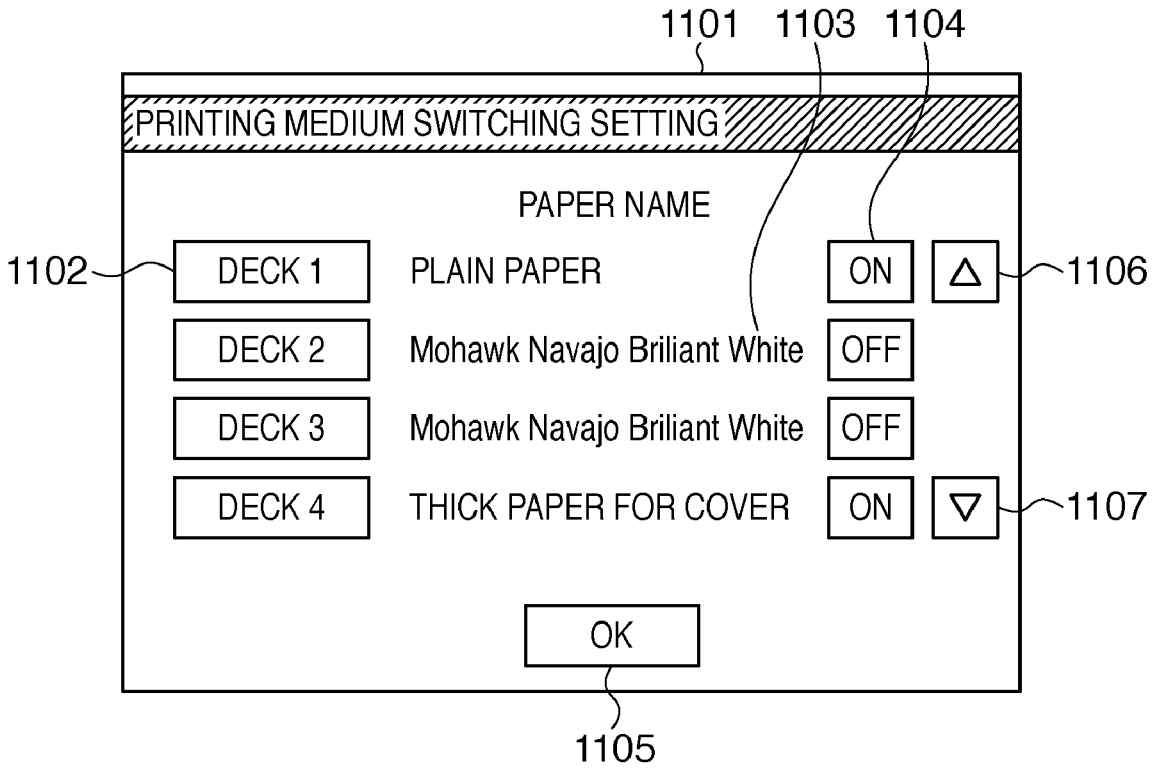
FIG. 15 is a view exemplifying a screen 1101 displayed on an operation unit 104 of a printing apparatus 100 according to the third embodiment.

FIG. 15 is a view exemplifying a screen 1101 displayed on an operation unit 104 of a printing apparatus 100 according to the third embodiment.

The screen 1101 displays the types of sheets stacked in feeding devices 105, 106, 120, 121, and 122. The screen 1101 displays character strings 1102, information display portions 1103, and buttons 1104, 1105, 1106, and 1107. The character strings 1102 are used to identify the feeding devices 105, 106, 120, 121, and 122. The information display portions 1103 represent the types and sizes of sheets stacked in the feeding devices 105, 106, 120, 121, and 122. The button 1104 is a switch button for permitting, for each of the feeding devices 105, 106, 120, 121, and 122, a function of, when sheets stacked in a feeding device run out, automatically changing the feeding device and feeding sheets. The button 1105 is used to end the screen 1101. The buttons 1106 and 1107 are used to scroll the image and display feeding device information which cannot be displayed in the screen 1101. By manipulating the screen 1101, the user can make a sheet switching setting.

FIG. 16 is a view exemplifying the configurations of feeding devices capable of automatically changing a feeding device and feeding sheets when sheets stacked in the feeding device run out according to the third embodiment. Each deck shown in FIG. 16 corresponds to each feeding device (e.g., paper cassette). Each feeding device stacks sheets of one type. In FIG. 16, the screen 1101 displays a deck name, sheet size, sheet type, and information on whether sheet switching is possible. For example, decks 1, 2, 3, 6, and 9 allow automatically switching sheets during one print job. That is, the screen 1101 shows whether another deck stacks sheets usable instead of those stacked in a target deck.

The user makes these settings via the screen 1101 of FIG. 15. A ROM 310 or the like stores information (alternative printing material information) defined via the screen 1101.

In this example, there are nine feeding devices, and an automatically switchable feeding device is decided on in accordance with a sheet designated by print data. Automatic switching means, for example, when a feeding device used during a printing process runs out of sheets, switching to feeding from a feeding device which stacks switchable sheets. For example, when one print job uses two types of sheets, for example, A4 size/plain paper and A3/thick paper, decks 1, 2, 3, and 6 shown in FIG. 16 can feed sheets for the print data.

<Fixing Control>

Figure 17:
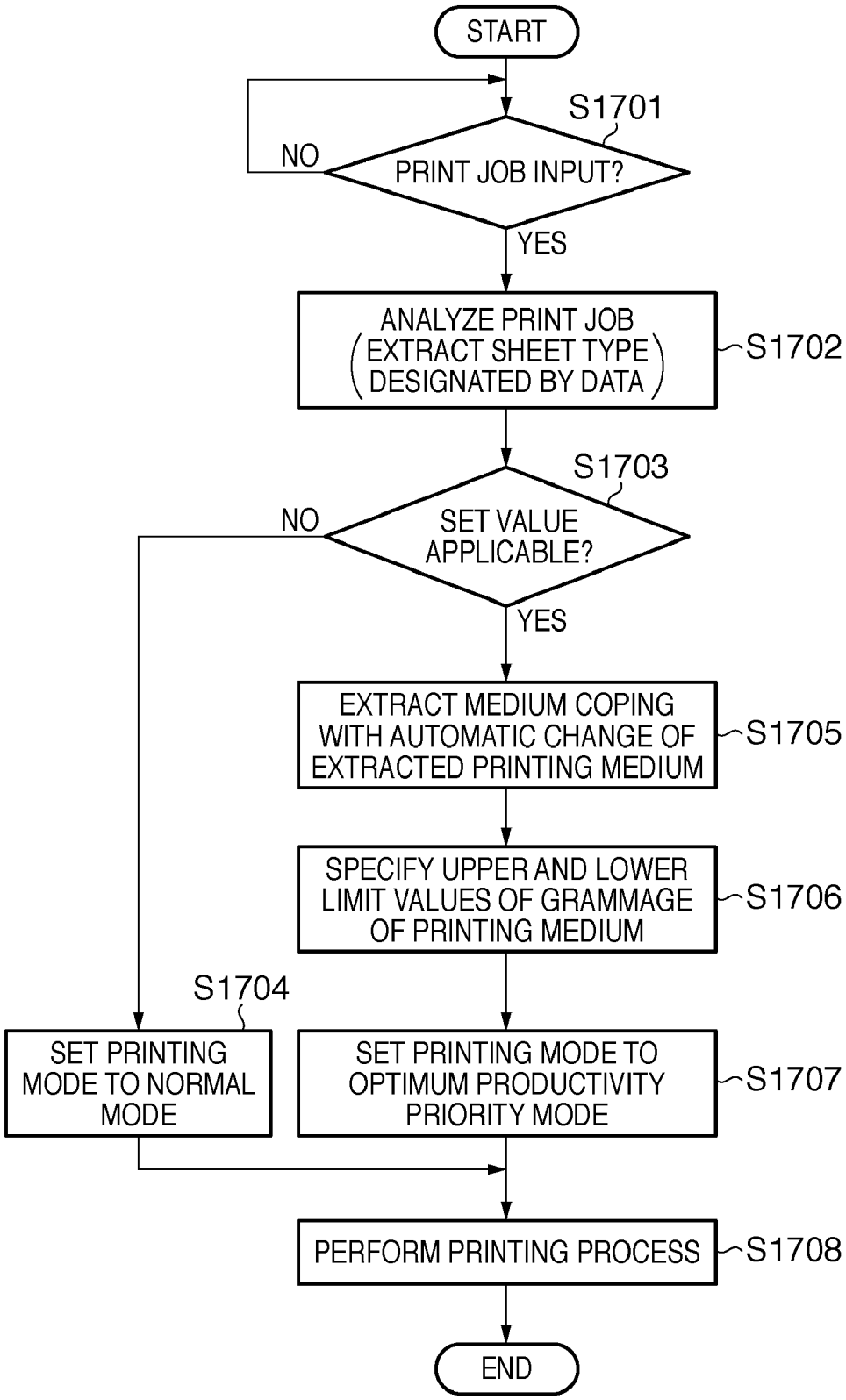
FIG. 17 is a flowchart showing the control procedures of fixing control according to the third embodiment.

FIG. 17 is a flowchart showing the control procedures of fixing control according to the third embodiment. A CPU 305 implements the following process by executing a program stored in a ROM 310. To explain the third embodiment, a print job requiring a plurality of types of sheets is assumed to be executed.

When the printing apparatus 100 is turned on and a process to start up each unit of the printing apparatus 100 is completed, the printing apparatus 100 shifts to a print job input standby state in step S1701. In step S1701, the CPU 305 determines whether a print job has been input. If a print job has been input, the process advances to step S1702.

In step S1702, the CPU 305 analyzes the print job input in step S1701. In the analysis process, the CPU 305 extracts information representing the types of all sheets used in a printing process based on the input print job, and information (information representing the surface property and shape of a sheet) accessory to the sheet type. More specifically, the CPU 305 analyzes the print job stored in an HDD 311, and extracts information which specifies a sheet type used when performing a printing process for each page contained in the print job. Subsequently in step S1703, if pieces of information each representing a sheet type have been extracted, the CPU 305 determines whether a set value for controlling fixing units 115 and 116 can be one common to all the sheets used in the print job. More specifically, the CPU 305 determines whether a set value common to all the sheets is applicable, based on the information accessory to the sheet type that has been extracted in step S1702, and the table of FIG. 5 representing whether fixing control is applicable in accordance with the surface property and shape/material of a sheet. When only a piece of information representing a sheet type is extracted, the process advances to step S1704. When a common set value is applicable based on the extraction result of information accessory to the sheet type and the table of FIG. 5 representing whether fixing control is applicable in accordance with the surface property and shape/material of a sheet, the CPU 305 uses the tables of FIGS. 4 and 6 to further determine whether a common set value is applicable. If the CPU 305 determines in step S1703 that no common set value is applicable, it advances to step S1704; if it determines that a common set value is applicable, to step S1705.

In step S1704, the CPU 305 makes, for the fixing units 115 and 116, a setting, which is not used for a plurality of types of sheets, and then advances to step S1708. That is, for each sheet type used in the print job, a corresponding set value is applied in fixing control. In this case, importance is placed on the fixing control precision rather than the productivity. For descriptive convenience, this setting is defined as a normal mode.

In step S1705, the CPU 305 extracts the type of sheet which may be printed by a print job containing information of a sheet which may be automatically switched to another sheet when sheets run out, as described with reference to FIG. 16. At this time, the CPU 305 functions as the second extraction means. In step S1706, the CPU 305 specifies the upper and lower limit values of the grammages of a plurality of types of sheets based on the extracted sheet information of the print job. In step S1707, the CPU 305 decides the set value of the fixing units 115 and 116 based on the specified upper and lower limit values of the sheet grammage, and the table of FIG. 4 representing the relationship between the upper and lower limit values of the sheet grammage and the set value of the fixing temperature. That is, a set value in fixing control that is common to a plurality of types of sheets used in the print job is applied. In this case, importance is placed on the productivity rather than the fixing control precision. For descriptive convenience, this setting is defined as a productivity priority mode.

In step S1708, based on the set value decided in step S1704 or S1707, the CPU 305 controls the fixing units 115 and 116 to execute a printing process. A printing process when a common set value of the fixing temperature is applied to a plurality of types of sheets and a printing process when a corresponding set value of the fixing temperature is applied to each sheet type used in a print job are the same as those described in the first embodiment, and a description thereof will not be repeated.

As described above, upon receiving a print job, the image forming apparatus extracts a sheet type for use and an alternative type. If a plurality of types are extracted, the image forming apparatus determines whether a set value common to the extracted sheet types can be used for fixing control in the fixing unit. If a common set value can be used for the fixing control, the image forming apparatus decides a common set value. If no common set value can be used for the fixing control, the image forming apparatus decides a set value for each type. In accordance with the decided set value, the image forming apparatus executes the fixing control in the fixing unit. In this manner, the image forming apparatus according to the third embodiment decides a set value (e.g., temperature value or pressure value) in fixing control in accordance with a combination of a sheet type used in a print job and a sheet type alternative to the sheet for use while taking account of the productivity or fixing control precision. The image forming apparatus can achieve fixing control which minimizes a decrease in productivity and the burden on the fixing unit. The image forming apparatus decides a set value based on a sheet type used in a print job and a sheet type alternative to the sheet for use. The image forming apparatus can perform fixing control considering even a case in which the feeding device runs out of sheets. The third embodiment may be applied in combination with the first and second embodiments.

<Other Embodiments>

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-013396 filed on Jan. 23, 2009, which is hereby incorporated by reference herein in its entirety.

What is claimed is:

1. A printing apparatus comprising:

an input unit that inputs a print job containing image data of a plurality of pages;

a printing unit that includes a transfer unit transferring a developer to a printing material and a fixing unit fixing the transferred developer to the printing material, and executes a printing process for a plurality of types of printing materials based on the print job, an extraction unit that extracts a type of printing material used in the printing process based on the print job;

a determination unit that, in a case where the extraction unit extracts a plurality of types, determines whether a set value common to the plurality of types of printing materials can be used for fixing control in the fixing unit when executing the printing process for the plurality of extracted types of printing materials;

a decision unit that, in a case where the determination unit determines that the common set value can be used for the fixing control, decides a set value common to the plurality of types of printing materials used in the printing process based on the print job, and in a case where the determination unit determines that the common set value cannot be used for the fixing control, decides a plurality of set values for the respective types of printing materials used in the printing process based on the print job; and an execution unit that executes the fixing control in the fixing unit in accordance with the set value decided by the decision unit, wherein in a case where the printing process starts and then is interrupted, the extraction unit extracts a type of printing material used in a printing process of image data of a page not having undergone the printing process, in a case where the extraction unit extracts a plurality of types, the determination unit determines whether a set value common to the plurality of types of printing materials can be used for fixing control in the fixing unit when executing the printing process for the plurality of extracted types of printing materials, in a case where the determination unit determines that the common set value can be used for the fixing control, the decision unit decides a set value common to the plurality of types of printing materials used in the print job, and when the determination unit determines that the common set value cannot be used for the fixing control, decides a plurality of set values for the respective types of printing materials used in the printing process based on the print job, and when resuming the interrupted printing process, the execution unit executes the fixing control in the fixing unit in accordance with the set value decided by the decision unit.

2. The apparatus according to claim 1, further comprising a unit that generates an interruption when execution of a printing process becomes possible while the extraction unit extracts a type of printing material, wherein in a case where the extraction unit has extracted a plurality of types upon generation of the interruption, the determination unit determines whether a set value common to the plurality of types of printing materials can be used for fixing control in the fixing unit when executing the printing process for the plurality of extracted types of printing materials, in a case where the determination unit determines that the common set value can be used for the fixing control, the decision unit decides a set value common to the extracted printing materials, and in a case where the determination unit determines that the common set value cannot be used for the fixing control, decides a plurality of set values for the respective types of printing materials used in the printing process based on the print job, and the execution unit executes the fixing control in the fixing unit in accordance with the set value decided by the decision unit.

3. The apparatus according to claim 1, further comprising:

a plurality of feeding units that stack printing materials;

a switching unit that, when printing materials stacked in a feeding unit in use run out during execution of the printing process, switches to feed printing materials from another feeding unit; and a definition unit that defines an alternative printing material which, when printing materials stacked in the feeding unit in use run out during execution of the printing process, is printable instead of the printing materials, wherein the extraction unit further extracts a type of alternative printing material defined by the definition unit.

4. The apparatus according to claim 1, wherein the set value includes at least either of a temperature value for applying heat to a printing material in the fixing control, and a pressure value for applying pressure to a printing material.

5. The apparatus according to claim 4, wherein the execution unit executes the fixing control to set a temperature of the fixing unit to a temperature value decided by the decision unit, and the printing unit starts the printing process based on the print job when the temperature of the fixing unit reaches the temperature value decided by the decision unit in the fixing control.

6. The apparatus according to claim 1, wherein the type of printing material includes at least one of a surface property, a shape, and a material.

7. The apparatus according to claim 1, further comprising a storage unit that stores characteristic values of a plurality of types of printing materials for which the printing unit can execute a printing process, wherein the determination unit determines, based on the characteristic value of each of the plurality of types of printing materials extracted by the extraction unit, whether a set value common to the plurality of types of printing materials can be used for the fixing control.

8. The apparatus according to claim 7, wherein the characteristic value includes a value representing a grammage of the printing material.

9. The apparatus according to claim 1, further comprising a storage unit that stores characteristic values of a plurality of types of printing materials for which the printing unit can execute a printing process, wherein the decision unit decides, based on the characteristic value of each of the plurality of types of printing materials extracted by the extraction unit, a set value common to the plurality of types of printing materials used in the print job.

10. A method of controlling a printing apparatus comprising a printing unit that includes a transfer unit transferring a developer to a printing material and a fixing unit fixing the transferred developer to the printing material, and executes a printing process for a plurality of types of printing materials based on the print job, the method comprising:

extracting a type of printing material used in the printing process based on the print job, in a case where a plurality of types are extracted in the extracting step, determining whether a set value common to the plurality of types of printing materials can be used for fixing control in the fixing unit when executing the printing process for the plurality of extracted types of printing materials;

in a case where the common set value is determined in the determining step to be able to be used for the fixing control, deciding a set value common to the plurality of types of printing materials used in the printing process based on the print job, and in a case where the common set value is determined in the determining step not to be able to be used for the fixing control, deciding a plurality of set values for the respective types of printing materials used in the printing process based on the print job; and executing the fixing control in the fixing unit in accordance with the set value decided in the deciding step, wherein in a case where the printing process starts and then is interrupted, in the extracting step, a type of printing material used in a printing process of image data of a page not having undergone the printing process is extracted, in the determining step, in a case where a plurality of types are extracted in the extracting step, whether a set value common to the plurality of types of printing materials can be used for fixing control in the fixing unit when executing the printing process for the plurality of extracted types of printing materials is determined, in the deciding step, in a case where the common set value is determined in the determining step to be able to be used for the fixing control, a set value common to the plurality of types of printing materials used in the print job is decided, and when the common set value is determined in the determining step not to be able to be used for the fixing control, a plurality of set values are decided for the respective types of printing materials used in the printing process based on the print job, and in the executing step, when resuming the interrupted printing process, the fixing control in the fixing unit is executed in accordance with the set value decided in the deciding step.

11. The method according to claim 10, further comprising generating an interruption when execution of a printing process becomes possible while a type of printing material is extracted in the extracting step, wherein in the determining step, in a case where a plurality of types have been extracted in the extracting step upon generation of the interruption, whether a set value common to the plurality of types of printing materials can be used for fixing control in the fixing unit when executing the printing process for the plurality of extracted types of printing materials is determined, in the deciding step, in a case where the common set value is determined in the determining step to be able to be used for the fixing control, a set value common to the extracted printing materials is decided, and in a case where the common set value is determined in the determining step not to be able to be used for the fixing control, a plurality of set values are decided for the respective types of printing materials used in the printing process based on the print job, and in the executing step, the fixing control in the fixing unit is executed in accordance with the set value decided in the deciding step.

12. The method according to claim 10, further comprising:

when printing materials stacked in a feeding unit of the printing apparatus run out during execution of the printing process, switching to feed printing materials from another feeding unit; and defining an alternative printing material which, when printing materials stacked in the feeding unit in use run out during execution of the printing process, is printable instead of the printing materials, wherein in the extracting step, a type of alternative printing material defined in the defining step is further extracted.

13. The method according to claim 10, wherein the set value includes at least either of a temperature value for applying heat to a printing material in the fixing control, and a pressure value for applying pressure to a printing material.

14. The method according to claim 13, wherein in the executing step, the fixing control is executed to set a temperature of the fixing unit to a temperature value decided in the deciding step, and the printing process by the printing unit starts when the temperature of the fixing unit reaches the temperature value decided in the deciding step in the fixing control.

15. The method according to claim 10, wherein the type of printing material includes at least one of a surface property, a shape, and a material.

16. The method according to claim 10, wherein the printing apparatus includes a storage unit that stores characteristic values of a plurality of types of printing materials for which the printing unit can execute a printing process, and in the determining step, whether a set value common to the plurality of types of printing materials can be used for the fixing control is determined based on the characteristic value of each of the plurality of types of printing materials extracted in the extracting step.

17. The method according to claim 16, wherein the characteristic value includes a value representing a grammage of the printing material.

18. The method according to claim 10, wherein the printing apparatus includes a storage unit that stores characteristic values of a plurality of types of printing materials for which the printing unit can execute a printing process, and in the deciding step, a set value common to the plurality of types of printing materials used in the print job is decided based on the characteristic value of each of the plurality of types of printing materials extracted in the extracting step.

* * * * *